US006029632A

United States Patent [19]

Augustin

[11] Patent Number: 6,029,632

[45] Date of Patent: Feb. 29, 2000

[54] FUEL INJECTOR WITH MAGNETIC VALVE CONTROL FOR A MULTICYLINDER INTERNAL COMBUSTION ENGINE WITH DIRECT FUEL INJECTION

[75] Inventor: Ulrich Augustin, Kernen, Germany

[73] Assignee: DaimlerChrysler AG, Stuttgart, Germany

[21] Appl. No.: 09/120,147

[22] Filed: Jul. 21, 1998

[51] Int. Cl.[7] ..... F02M 37/04

[52] U.S. Cl. ..... 123/506; 123/467

[58] Field of Search ..... 123/500, 501, 123/506, 458, 467

[56] References Cited

U.S. PATENT DOCUMENTS

| | | | |
|---|---|---|---|
| 4,566,416 | 1/1986 | Berchtold | 123/458 |
| 5,076,241 | 12/1991 | Takahashi | 123/506 |
| 5,347,970 | 9/1994 | Pape | 123/506 |
| 5,526,791 | 6/1996 | Timmer et al. . | |
| 5,605,134 | 2/1997 | Martin | 123/467 |
| 5,662,087 | 9/1997 | McCandless | 123/506 |

FOREIGN PATENT DOCUMENTS

| | | |
|---|---|---|
| 43 41 546 | 6/1995 | Germany . |
| 196 12 738 | 10/1996 | Germany . |
| 196 21 583 | 1/1997 | Germany . |
| 58 98655 | 6/1981 | Japan . |
| 2 322 414 | 8/1998 | United Kingdom . |
| 2 322 415 | 8/1998 | United Kingdom . |

*Primary Examiner*—Carl S. Miller
*Attorney, Agent, or Firm*—Klaus J. Bach

[57] ABSTRACT

In a fuel injector for direct fuel injection into a cylinder of an internal combustion engine under the control of an electromagnetic valve, wherein an injector housing has a control piston and a valve body disposed in a cylindrical opening formed therein whereby the high pressure fuel supply to a nozzle valve at one end of the injector is controlled, the valve body forms a valve whose downstream end is in communication, by way of a throttle structure, with a low pressure fuel return line through whichfuel under pressure can be released, the discharge of fuel from the downstream end of the valve body to the return line being further controlled such that fuel can be discharged to the fuel return line only when the nozzle valve is closed.

6 Claims, 2 Drawing Sheets

FUEL INJECTOR WITH MAGNETIC VALVE CONTROL FOR A MULTICYLINDER INTERNAL COMBUSTION ENGINE WITH DIRECT FUEL INJECTION

BACKGROUND OF THE INVENTION

The invention relates to a magnetic valve controlled fuel injector for a multi-cylinder internal combustion engine with direct fuel injection. The fuel injector includes in an injector housing a control piston and a valve body cooperating with the control piston. A high pressure line extends to the valve body and is, when the valve body is open, in communication with a fuel supply line which leads to a pressure chamber surrounding an injection nozzle valve needle. A passage extends through the control piston and the valve body by way of which a control space delimited by the control piston is constantly in communication with the high pressure line by way of a throttle structure. The pressure in the control space can be released by the magnetic valve to control the injection. A fuel return line is provided which also includes a throttle structure.

Such a magnetic valve controlled fuel injector is known from DE 196 12 738 A1, wherein the control piston with an integrated valve body is guided in two housing parts and has a backside which is in direct contact with the nozzle needle: the valve body is surrounded by an annular space to which a fuel admission line leads and to which also a throttled return line to a low pressure fuel storage is connected.

In this type of system, the high pressure line leading to the injection nozzle is pressure-relieved by the throttled return line, that is by the constant communication path between the supply line by way of the annular space and the low pressure return line.

It is the object of the present invention to provide a fuel injector with which, by inexpensive measures, the efficiency is substantially improved.

SUMMARY OF THE INVENTION

In a fuel injector for direct fuel injection into a cylinder of an internal combustion engine under the control of an electromagnetic valve, with an injector housing having a control piston and a valve body disposed in a cylindrical opening in the injector housing whereby the high pressure fuel supply to a nozzle needle valve at one end of the injector is controlled, the valve body forms a valve whose downstream end is in communication, by way of a throttle structure, with a low pressure return line, the discharge of fuel from the downstream end of the valve body to the fuel return line being further controlled such that fuel can be discharged to the fuel return line only when the nozzle needle valve is closed.

With the fuel injector according to the invention, the release of high pressure fuel from the high pressure fuel chamber is interrupted since the communication between the supply line leading to the injection nozzle and the return line which is in communication with the low pressure system is controllable such that pressure relief occurs only between injections, but not while injection takes place. Consequently, the return fuel flow is substantially decreased.

Two embodiments of the invention will be described below in greater detail on the basis of the accompanying drawings.

DESCRIPTION OF PREFERRED EMBODIMENT

Figure 1:
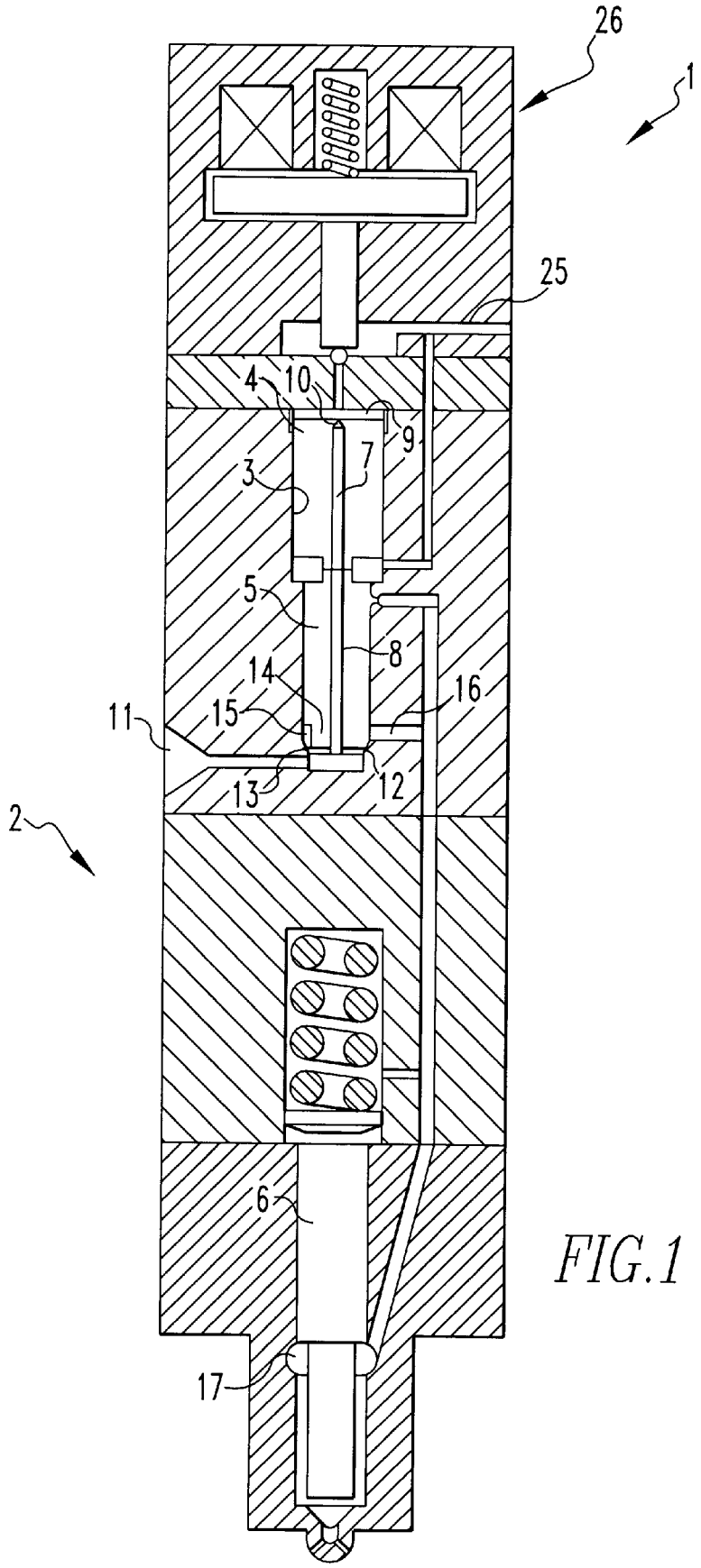
FIG. 1 is a longitudinal cross-sectional view of the fuel injector according to the invention.

As shown in FIG. 1, a magnetic valve-controlled fuel injector 1 for direct fuel injection as it is used preferably in connection with storage injection systems operating according to the common rail principle employed in multi-cylinder internal combustion engines includes a multi-port injector housing 2 having a stepped cylindrical opening 3, a control piston 4 axially movably disposed in the cylindrical opening 3 and a valve body 5 cooperating with the control piston 4. It further includes a spring-loaded nozzle needle 6 spatially separated from valve body 5 and the control piston 4.

The valve body 5 is in the form of a valve piston and is arranged co-axially with the control piston 4 of somewhat greater diameter. The control piston 4 includes an axial passage 7 which is in alignment with an axial passage 8 formed in the valve body 5. The control piston 4 and the valve body 5 are both disposed in a single housing part of the injector housing 2.

The control piston 4 delimits at its top end face a control chamber 9 with which the axial passage 7 is in communication by way of a throttle structure 10. With this throttle structure 10, a higher pressure will be established at the high pressure end of the control piston than in the control chamber 9 when the pressure is released from the control chamber 9 so that the valve body 5 is lifted off the valve seat 12.

The control chamber 9 is, by way of the coaxial passages 7, 8, in communication with a high pressure fuel supply line 11 extending radially in the injector housing 2. The valve body 5 includes a seating surface 13 corresponding to the conical valve seat 12 in the valve housing 2.

The seating surface 13 is formed on a cylindrical lug 14, which projects axially from the valve body 5 and has a diameter smaller than the valve body 5 so that an annular space 15 is formed around the lug 14 from which a fuel supply passage 16 extends to a pressure chamber 17 formed around the spring-loaded nozzle needle 6.

Figure 2:
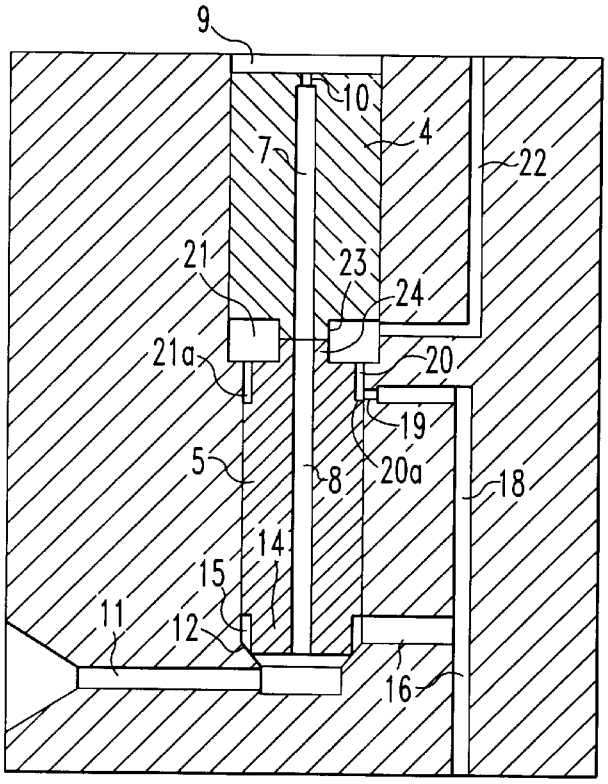
FIG. 2 is an enlarged cross-sectional view of the upper area of the fuel injector.

As shown in FIG. 2, a branch passage 18 provided with a relief throttle structure 19, extends from the fuel supply passage 16 to an annular control space 20 formed by a recess in he valve body 5, which controls communication of the branch passage 18 with the annular control space 20.

The annular control space 20 is in communication with a fuel return line 22 by way of the annular chamber 21 formed between the control piston 4 and the valve body 5. The annular chamber 21 is formed by an annular recess 24 in the valve body 5 and a similar annular recess 23 formed in the control piston 4, the annular chamber 21 being substantially larger than the annular control space 20.

In the position as shown in the figures wherein the valve body 5 is seated on the valve seat 12, a pressure relief communication path is established between the fuel supply passage 16 and the fuel return line 22 by way of the branch passage 18, the throttle structure 19 the annular control space 20 and the annular chamber 21.

As soon as the pressure is released from the control chamber 9 by way of a pressure relief passage 25 by activation of the magnetic valve 26 (FIG. 1), the valve body 5 is lifted off the valve seat 12 by the higher pressure effective at the cylindrical lug 14 of the valve body 5 and the throttle structure 19 is closed by the control edge 20*a* whereby communication of the fuel supply passage 16 with the fuel return passage 25 is interrupted during fuel injection.

The annular chamber 21 is in constant communication with the fuel return passage 25 independently of the position of the valve body 5—in contrast to the fuel supply passage 16 whose communication with the fuel return line 22 is interrupted when the valve body 5 is lifted during fuel injection.

Figure 3:
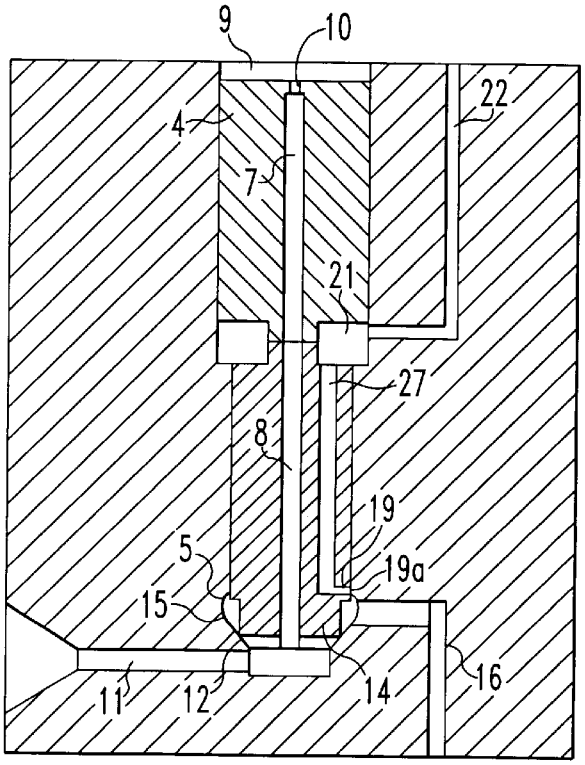
FIG. 3 is an enlarged cross-sectional view of the upper area of the injector showing another embodiment.

As shown in FIG. 3, the throttle structure 19 does not need to be disposed in the injector housing 2 but may be disposed in the control piston 4 and is in communication with the annular chamber 21 by way of a longitudinal bore 27 extending through the valve body 5.

The throttle structure 19 as shown in FIG. 3 extends radially through the valve body 5 at a small distance from the cylindrical lug 14 and the annular space 15 is extended axially such that the throttle structure is in communication with the annular space 15 when the valve body 5 is seated. The opening 19*a* of the throttle structure 19 is disposed at the upper edge of the annular space 15 such that communication between the annular space 15 and the fuel return line through the throttle structure 19 is interrupted as soon as the valve body 5 is lifted off the valve seat 12.

What is claimed is:

1. A fuel injector for direct fuel injection into a cylinder of a multi-cylinder internal combustion engine, said injector having an electromagnetic injection control arrangement and including an injector housing, a control piston and a valve body axially movably disposed in a cylindrical opening formed in said injector housing, an injection nozzle needle disposed at one end of said injector housing for controlling fuel injection into a cylinder of said engine, and an annular pressure chamber extending around an end portion of said injection nozzle needle for releasing fuel therefrom when said nozzle needle is lifted, said valve body forming a valve having a seating surface adapted to be seated on a valve seat for closing a pressurized fuel supply line and said control piston and said valve body having axially aligned passages providing for communication of said pressurized fuel supply line with a magnetic valve controlled control chamber at the end of said control piston opposite said valve body, said high pressure fuel supply line extending through said injector housing and leading to said annular pressure chamber around said injection nozzle needle through said valve body, said valve body and said control piston having annular recesses formed in adjacent end faces, which together form an annular chamber which is in communication with a fuel return line, said valve body and said control piston being movable by a pressure release from said control chamber upon energization of said magnetic valve so as to open said valve for supplying high pressure fuel to said annular pressure chamber, and said fuel supply line being in communication with said annular chamber by way of a pressure relief passage, which is controlled by said valve body so as to be closed when said valve body is lifted during fuel injection into an associated engine cylinder.

2. A fuel injector according to claim 1, wherein said pressure relief passage includes a throttle structure for limiting the fluid flow to said fuel return line.

3. A fuel injector according to claim 1, wherein said pressure relief passage is a branch passage extending through the injector housing and leading from said fuel supply passage to an annular control space which is formed in said valve body and which is in communication with said annular chamber and said fuel return line, said valve body blocking said branch passage during fuel injection.

4. A fuel injector according to claim 2, wherein said throttle structure extends to a bore extending through said valve body to said annular chamber which is in communication with said fuel return line, said throttle structure in said valve body being blocked during fuel injection when said valve body is lifted off its seat.

5. A fuel injector according to claim 1, wherein said valve body and said control piston which has somewhat greater diameter as well as the axial passages extending therethrough are in axial alignment and the adjacent end faces of the control piston and of the valve body are sealingly engaged with each other and the axial passage extending through said control piston includes a throttle structure at its end adjacent said control chamber.

6. A fuel injector according to claim 4, wherein said valve body includes a longitudinal bore extending between said annular chamber and an annular space around the valve seat at the end of said control piston.

* * * * *